US012691550B2

(12) United States Patent
Farrow

(10) Patent No.: US 12,691,550 B2
(45) Date of Patent: Jul. 28, 2026

(54) INSERT FOR USE IN DRY BLASTING

(71) Applicant: FHG Inc., Downingtown, PA (US)

(72) Inventor: Nigel Richard Farrow, Downingtown, PA (US)

(73) Assignee: Farrow Holdings Group, Inc., Downingtown, PA (US)

( * ) Notice: Subject to any disclaimer, the term of this patent is extended or adjusted under 35 U.S.C. 154(b) by 598 days.

(21) Appl. No.: 18/029,310

(22) PCT Filed: Sep. 30, 2021

(86) PCT No.: PCT/IB2021/059005
§ 371 (c)(1),
(2) Date: Mar. 29, 2023

(87) PCT Pub. No.: WO2022/070133
PCT Pub. Date: Apr. 7, 2022

(65) Prior Publication Data

US 2023/0364741 A1 Nov. 16, 2023

Related U.S. Application Data

(60) Provisional application No. 63/085,329, filed on Sep. 30, 2020.

(51) Int. Cl.
*B24C 7/00* (2006.01)

(52) U.S. Cl.
CPC ..... *B24C 7/0053* (2013.01)

(58) Field of Classification Search
CPC ..... F16L 33/00; B24C 5/02; B24C 7/0015; B24C 7/0053; B24C 7/053
See application file for complete search history.

(56) References Cited

U.S. PATENT DOCUMENTS

| | | | | |
|---|---|---|---|---|
| 1,966,368 | A * | 7/1934 | Williams | F16L 33/226 24/703.1 |
| 5,565,063 | A | 10/1996 | Begemann et al. | |
| 2012/0141953 | A1 | 6/2012 | Mueller | |
| 2013/0112779 | A1* | 5/2013 | Giovannini | B24C 7/0046 239/488 |
| 2018/0142827 | A1 | 5/2018 | Farrow | |

FOREIGN PATENT DOCUMENTS

| | | | | |
|---|---|---|---|---|
| CN | 107 695 895 | A | 2/2018 | |
| CN | 108188939 | A * | 6/2018 | B24C 5/04 |
| EP | 0057920 | A1 * | 8/1982 | F16L 33/2076 |
| GB | 1 603 090 | A | 11/1981 | |
| KR | 20200043024 | A * | 4/2020 | B24C 7/0046 |
| WO | WO-2010070281 | A1 * | 6/2010 | F16L 11/121 |

* cited by examiner

*Primary Examiner* — Kenneth Rinehart
*Assistant Examiner* — Haotian Lu
(74) *Attorney, Agent, or Firm* — Axenfeld Law Group, LLC; Robert R. Axenfeld

(57) ABSTRACT

An insert securable to the end of a hose is disclosed, the insert primarily intended to improve flow of a fluid emerging from the hose. The insert includes a generally cylindrical body portion, said body portion comprising an internal helical channel, the axis of said helical channel being offset from the insert axis, and conveniently parallel thereto.

11 Claims, 15 Drawing Sheets

60

61
DETAIL C
SCALE 2:1

60

61
C 57
50

SECTION A-A
SCALE 1:5

DETAIL B
SCALE 3:1

SECTION A-A
SECTION C-C
DETAIL B
SCALE 2.50 : 1

INSERT FOR USE IN DRY BLASTING

CROSS-REFERENCE TO RELATED APPLICATIONS

This application is a U.S. National Phase Application of International Patent Application No. PCT/IB2021/059005, filed Sep. 30, 2021, which claims the benefit of U.S. Provisional Patent Application No. 63/085,329, filed Sep. 30, 2020, the disclosures of which are hereby incorporated by reference in their entirety.

TECHNICAL FIELD

The present invention relates to an insert which improves the efficiency when dry-blasting a surface to remove surface coatings or the like. In particular, the insert is inserted into the flow-line of pressurised fluid, usually air, which can carry a solid blast medium and impacts said medium against the surface. Inserts in accordance with the invention, can however also be utilised in other technical situations where the flow of fluid is important.

BACKGROUND TO THE INVENTION

The use of blasting is an important process used in the restoration and reclamation of materials and also simply to clean objects to bring them back to an earlier state. So, for example, steel structures are cleaned to remove rust or an older protective coating in order to repair and/or provide a new protective coating such as a paint. Also, buildings and items of furniture can be cleaned to remove surface layers which build up over time.

There are 2 main methodologies utilised when blasting. Both involve the use of a carrier fluid to impact a particulate material, usually referred to as a medium, against the surface. In 'wet blasting', the fluid is a liquid, almost invariably water. In dry blasting, which is the concern of the present invention, the fluid is a gas, almost invariably air. The technique has been utilised since the late $19^{th}$ century, but continues to evolve.

One problem to be solved is the transfer of energy from the carrier fluid to the medium and also to minimise loss of energy before the target surface is impacted. Additionally, loss of velocity of the medium and a solid, which has a direct relationship with the kinetic energy is also an important factor. The problems associated with the fluid flow movement which are associated with said movement can be, for example, to maximise the mass flow, reduce the abrasion between different particles within the flow or substituent members of the material in question, to minimise the energy required to move the material etc.

Many forms of mass transfer utilise a conduit to guide the material and ensure that no material is lost during transport. Apart from the abovedescribed blasting process, well-known examples are in the domestic water supply, oil pipelines, gas supply pipes etc.

In the above applications, the flow of the material within a conduit is important. Interactions between individual constituents of the material and also between the material and the wall of the conduit can lead to energy losses, not least because of turbulent flow occurring. If the turbulence can be reduced therefore, then the reduction of momentum of the material is lessened, flow is faster and the energy required to transport the material decreased.

The present invention seeks to address the above problems and provide a more cost effective means of improving the flow of materials within a conduit and also to improve the flow as the material exits the conduit, for example from certain types of nozzles. The speed with which a material flows can therefore, for example, be increased or ordered thus saving transport energy. Moreover the time required when using nozzles to clean a particular surface is reduced which represents a cost saving in terms of labour and blast media, along with wear and tear to the nozzle.

SUMMARY OF THE INVENTION

According to a first aspect of the invention there is provided an insert, the insert being securable within the fluid pathway of a hose, the insert including a body portion having a fluid inlet and a fluid outlet, said body portion comprising an internal helical channel, the axis of said helical channel being offset from the insert axis.

The offset provides a more efficient amendment of fluid flow within a conduit when the insert is included in the fluid flow path of said conduit.

Preferably, the body portion is cylindrical.

Preferably, the helical channel is parallel to the insert axis to reduce chaotic fluid flow within the insert.

Preferably, at least one end of the insert has a chamfered surface to aid insertion into a hose or the like.

Preferably, at least one end of the insert has a threaded portion surface to aid insertion into a hose or the like.

Preferably, the helical channel has a constant width to maintain a smooth air flow. Alternatively, the helical channel is tapered, being wider at the fluid inflow end to accelerate air flow.

Preferably, the ratio of the channel diameter to the offset of the axis is from 0.5-1.3, and further preferably the ratio is from 0.7-1.3 to improve flow performance.

Preferably, the ratio of the channel diameter to the offset of the axis is y*7.5/5.75, where y is the diameter of the pipe in mm to which the fluid outlet of the insert is connected to improve flow performance.

Preferably, the body portion includes a flange about the fluid inlet to enable connection and prevent an insert from being inserted to far into a hose or the like. Further preferably, wherein a frusto-conical section connects the flange to the body portion, the frusto-conical section tapering in the direction of the fluid outlet to reduce the risk of an insert spinning during use.

Preferably, an insert is secured within a housing which housing is secured to a hose or the like to reduce the chance of the insert spinning whilst in use.

According to a second aspect of the invention, there is provided method of improving fluid flow, the method comprising the steps of selecting an insert, the insert having an internal helical channel, and positioning the insert onto the end of a hose such that the axis of the helical channel is offset from the hose axis, to alter the fluid flow of a fluid exiting the hose.

BRIEF DESCRIPTION OF THE DRAWINGS

The invention is now described with reference to the accompanying drawings which show, by way of example only, three embodiments of a transit seal plug. In the drawings:

FIGS. 8*a*-8*f* illustrate a second embodiment of an insert holder;

FIGS. 9*a*-9*d* illustrate a third embodiment of an insert holder;

DETAILED DESCRIPTION OF THE INVENTION

Figure 1A:
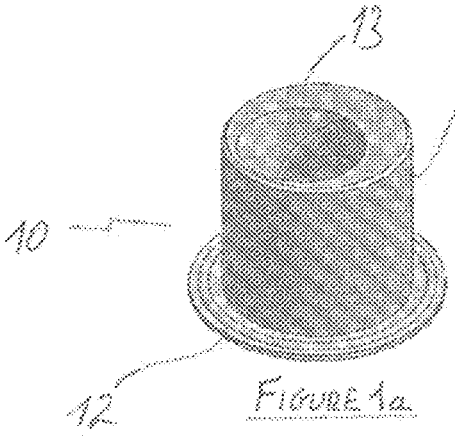
FIGS. 1*a*-1*f* illustrate a first embodiment of an insert.

The invention as described herein relates to an insert which when inserted into the flow of a fluid acts to change the flow patterns of the fluid and reduce undesired energy loss from the fluid which loss primarily, but without being bound to theory is believed to be due to conversion to thermal energy loss. Although the insert can find wide application within industry, wherever fluid flow occurs, the uses illustrated herein with respect to dry blasting technology are used to remove coatings from a surface.

In such usage, the basic operation of a blast machine is as follows. A source of pressurised fluid, usually compressed air is forced along a conduit such as a flexible hosepipe. At some point, before the air reaches the end of the conduit a blast medium is introduced into the flow and is then carried along with the fluid, taking up momentum energy from the fluid. At the end of the hose, there is usually a nozzle which an operator will direct towards the surface to be cleaned by impact of the transported medium against the surface. One of the major sources of energy loss from the system is friction, such as that between the fluid and medium and the wall of the conduit. This converts momentum energy into thermal energy, so lessening the impact of the medium against the surface. Another source is chaotic flow within the conduit. The present invention acts to improve the flow characteristics, so reducing the losses and improving the cleaning process: both in terms of time required and also the amount of blast medium required. The invention provides an insert, to be incorporated into the conduit which alters the flow characteristics of the fluid prior to introduction of the medium.

Referring initially to FIGS. 1*a*-1*f*, these illustrate a first embodiment of an insert, generally referenced 10. The insert is intended to be formed of a plastics material, although other materials suitable and known in the art can be utilised. The insert has a cylindrical body 11 of diameter 47 mm and height 42.81 mm, which in use is inserted into the hose of a blast machine. A flange 12, of thickness 3.88 mm and diameter 63.5 mm, at a first end of the cylindrical body 11, prevents the insert from being pushed too far into the hose and also facilitates the removal of an insert when not required or for replacement. The second end of the cylindrical body 11 has a chamfered surface 14 to facilitate insertion into the hose. The insert 10 is utilised such that the flow of fluid within the hose is from the first end towards the second end of the cylindrical body 11.

The internal volume of the cylindrical body 11 is primarily solid, with a helical passage 13 of diameter 32 mm is formed within the cylindrical body 11 which passage 13 acts to alter the fluid flow. Helical configurations and formations are known in the art and are believed to have primarily a rifling effect on the flow. However, the use of the phenomenon in blasting is confined it is believed to 1 phase systems. The positioning and the characteristics of the helix are here however such as to unexpectedly improve the performance.

Figure 1B:
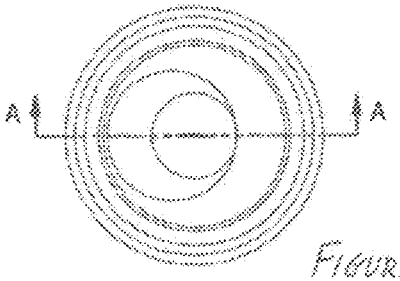
Figure 1C:
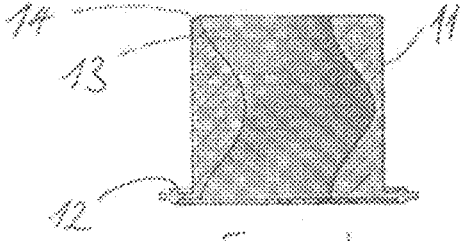
Figure 1D:
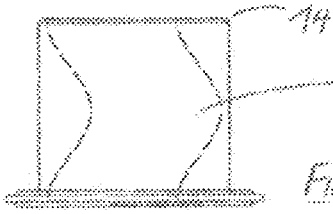
Figure 1E:
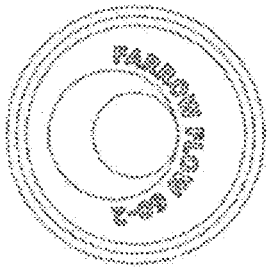
Figure 1F:
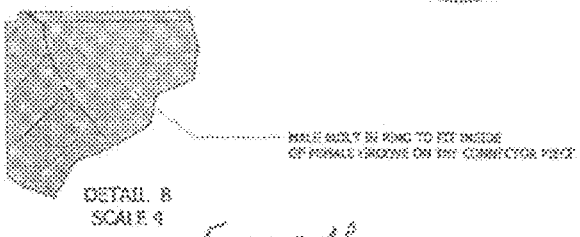
Figure 2D:
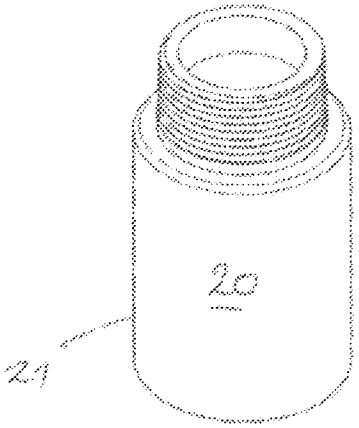
FIGS. 2*a*-2*d* illustrate a second embodiment of an insert.
Figure 2B:
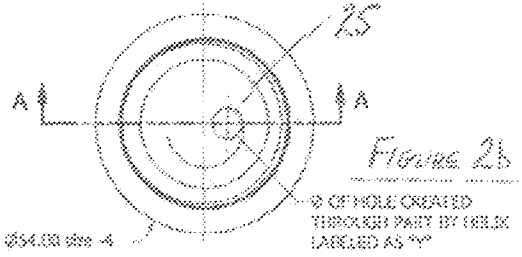
Figure 2C:
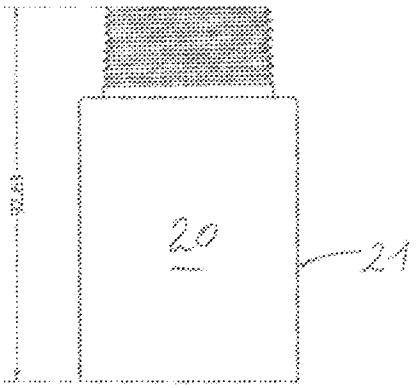
Figure 2A:
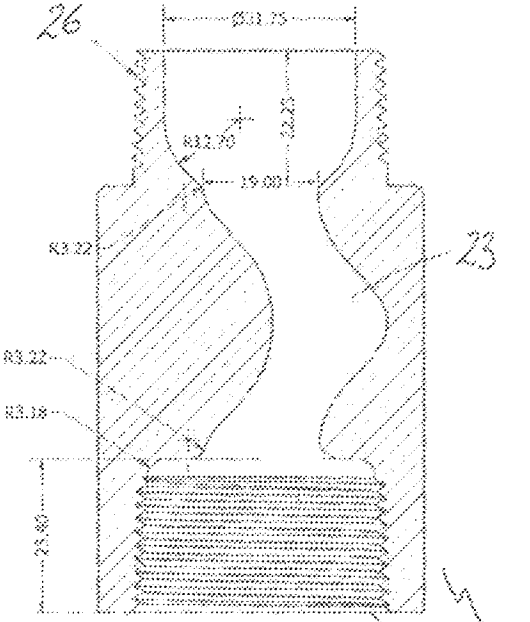
Figure 3D:
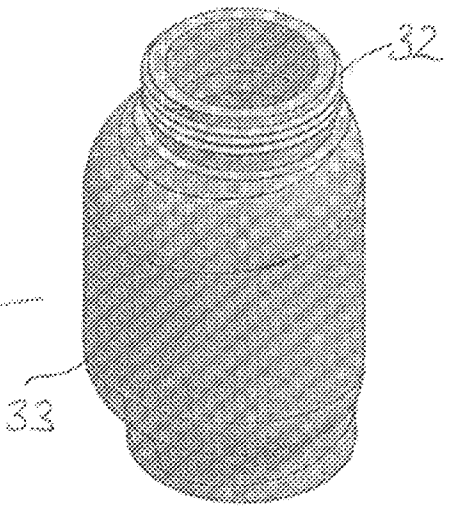
FIGS. 3*a*-3*d* illustrate a third embodiment of an insert.
Figure 3C:
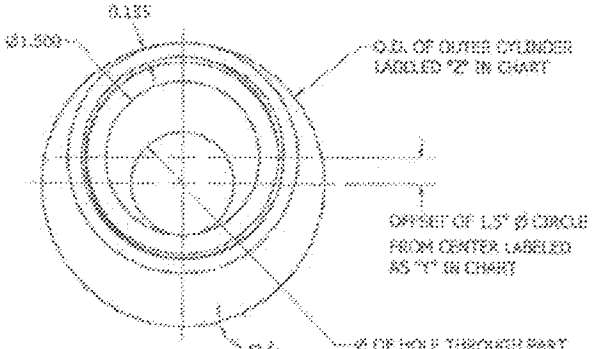
Figure 3B:
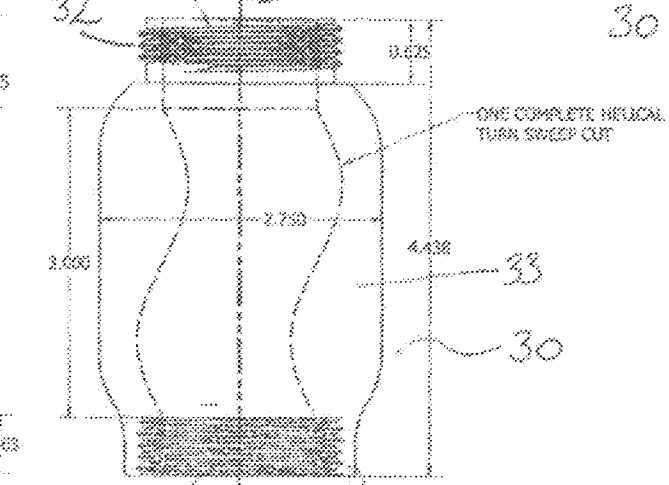
Figure 3A:
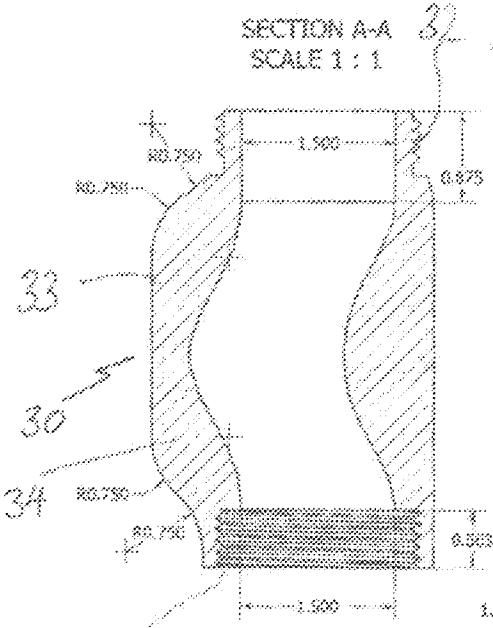
Figure 4A:
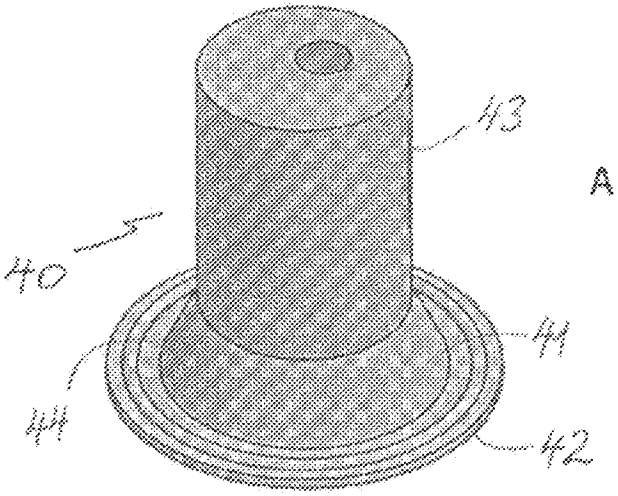
FIGS. 4*a*-4*f* illustrate a fourth embodiment of an insert.
Figure 4B:
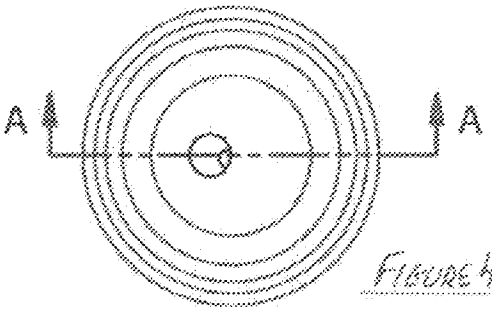
Figure 4F:
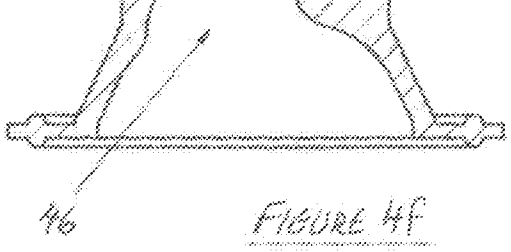
Figure 4C:
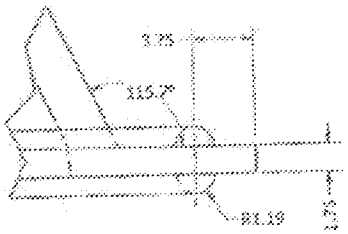
Figure 4D:
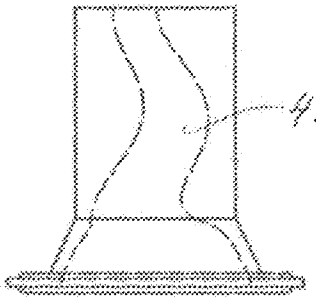
Figure 4E:
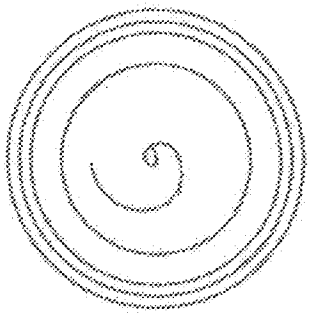
Figure 7A:
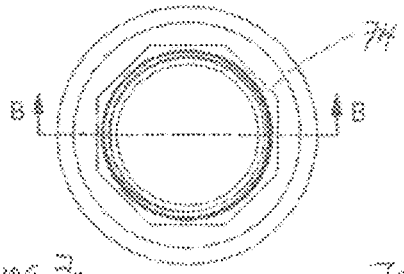
FIGS. 7*a*-7*e* illustrate a first embodiment of an insert holder.
Figure 7B:
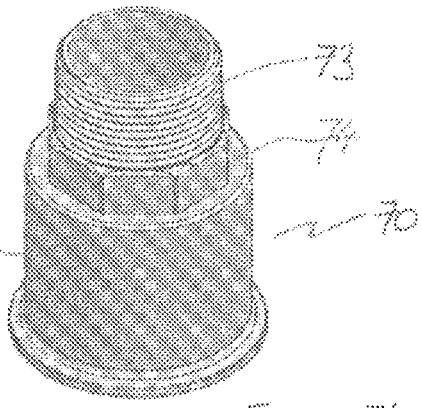
Figure 7C:
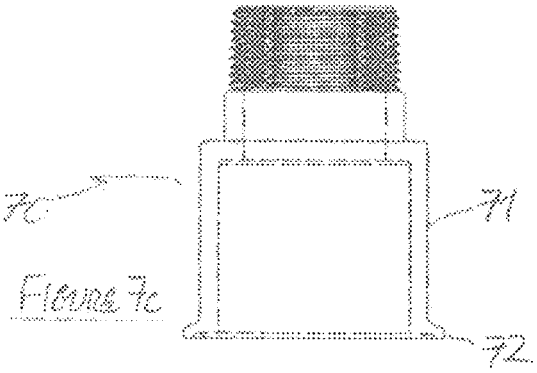
Figure 7D:
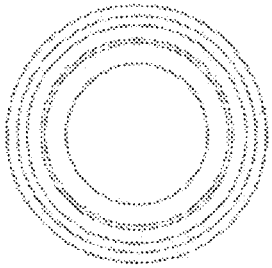
Figure 7E:
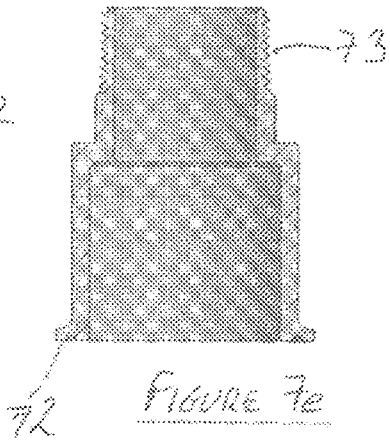

From FIGS. 1*b*, 1*c*, and 1*d* it can be seen that in this embodiment, the axis of the helical passage is offset from the central axis of the cylindrical body 11 of the insert 10. It has been found that this significantly increases the reduction in power loss to aid in the cleaning process.

The embodiment of insert 20 shown in FIGS. 2*a*-2*d* again has a cylindrical body 21 in which a helical passage 23 is formed. In order to connect the insert 20 to a hose, a first end of the insert 20 has a first, internal, thread 24 and at the second end a second, external, thread 26. The threads 24, 26 allow for connection to a holder (described below) which is inserted into the hose. The diameter of the cylindrical body 21 can be chosen to suit the task but diameters of from 46-52 mm have been found to be suitable. It can be seen from FIG. 2*b* that in plan view, the helical passage 23 is so formed as to provide a cylindrical channel 25 through from the first to the second ends of the insert 20. The insert 20 is intended in this embodiment to be utilised to link to an exit pipe of 31.75 mm diameter. It has been found that the size of this channel and the offset of the channel axis from the main cylindrical axis of the cylindrical body has an important effect on the cleaning characteristics. In the exemplified second embodiment, 4 values for each of these parameters were chosen. In a first experiment a channel diameter of 10 mm and an offset of 4.5 mm were chosen. In a second experiment, a channel diameter of 7.5 mm and an offset of 5.75 mm were chosen. In a third experiment, a channel diameter of 5 mm and an offset of 7 mm were chosen and in a fourth experiment, a channel diameter of 2.5 mm and an offset of 8.25 mm were chosen. In cleaning experiments of removing a coating from a surface it was found that the third experiment yielded improved cleaning compared to the other experiments and that the second experiment, yielded improved cleaning over the first experiment.

It has been found that where a second pipe, connected to the fluid exit of the insert has a diameter different from 31.75 mm then the ratio of channel diameter to offset of 7.5/5.75, can be utilised to determine the channel diameter and offset of an inset of a size suitable for the second pipe. Namely, where the second pipe has a diameter of y mm, the helical channel should have a diameter of y*7.5/5.75 mm and an offset of y*7.5/5.75 mm.

Turning to FIGS. 3*a*-3*d*, in which the values given are in inches, not mm, these show a third embodiment of an insert 30. The structure of the insert 30 is as for the above second embodiment in that screw threads 31, 32 are provided for attachment to a holder inserted into a hose. The body 33 however, is increased in thickness in one region 34 to accommodate the machine to which the insert 30 is to be attached. Again, two versions were provided in which in the first version, a channel diameter of 0.26" and offset of 0.12" were provided and a second version in which a channel diameter of 0.2" and an offset of 0.15" were provided.

In FIGS. 4*a*-4*f*, a fourth embodiment of insert is disclosed. The insert 40 is similar to that shown in FIG. 1, but includes a frusto-conical section 41 interposed between the flange 42 and the cylindrical body 43. The frusto-conical section 41 facilitates insertion of the insert 40 into a hose. Moreover, the frusto-conical section 41, due to the resilient nature of the plastics material from which the insert is formed, frictionally engages the hose into which it is inserted and acts to prevent the insert 40 from spinning during use. In an alternative embodiment, not illustrated, a groove notch arrangement can be utilised to prevent spinning from occurring. In the enlarged view shown in FIG. 4*c*, it can be seen that the angle between the flange 42 and the wall 44 of the frusto-conical section 41 is around 115.7°. Other values of angle can be used as determined by a person skilled in the art.

The fourth embodiment includes a channel of non-constant width. At a first inlet end, where the fluid enters the insert 40, the diameter of the helical channel 45 at the location indicated at 46 is 19 mm. At the outlet end as indicated at 47, the channel has a diameter of 9 mm. The narrowing of the helical passage 45 again affects the flow of fluid along the hose into which the air flows from the outlet 47, providing acceleration to the air-flow and reducing energy loss.

FIGS. 5*a*-5*f* illustrate a fifth embodiment of insert 50. The internal helical structure of the insert 50 is as for the previous embodiments. Externally however, this embodiment includes an externally deployed screw-thread 51 to enable the fitment into a hose or into a holder as described below.

Figures 5A, 5B, 5C, 5D, 5E, 5F:
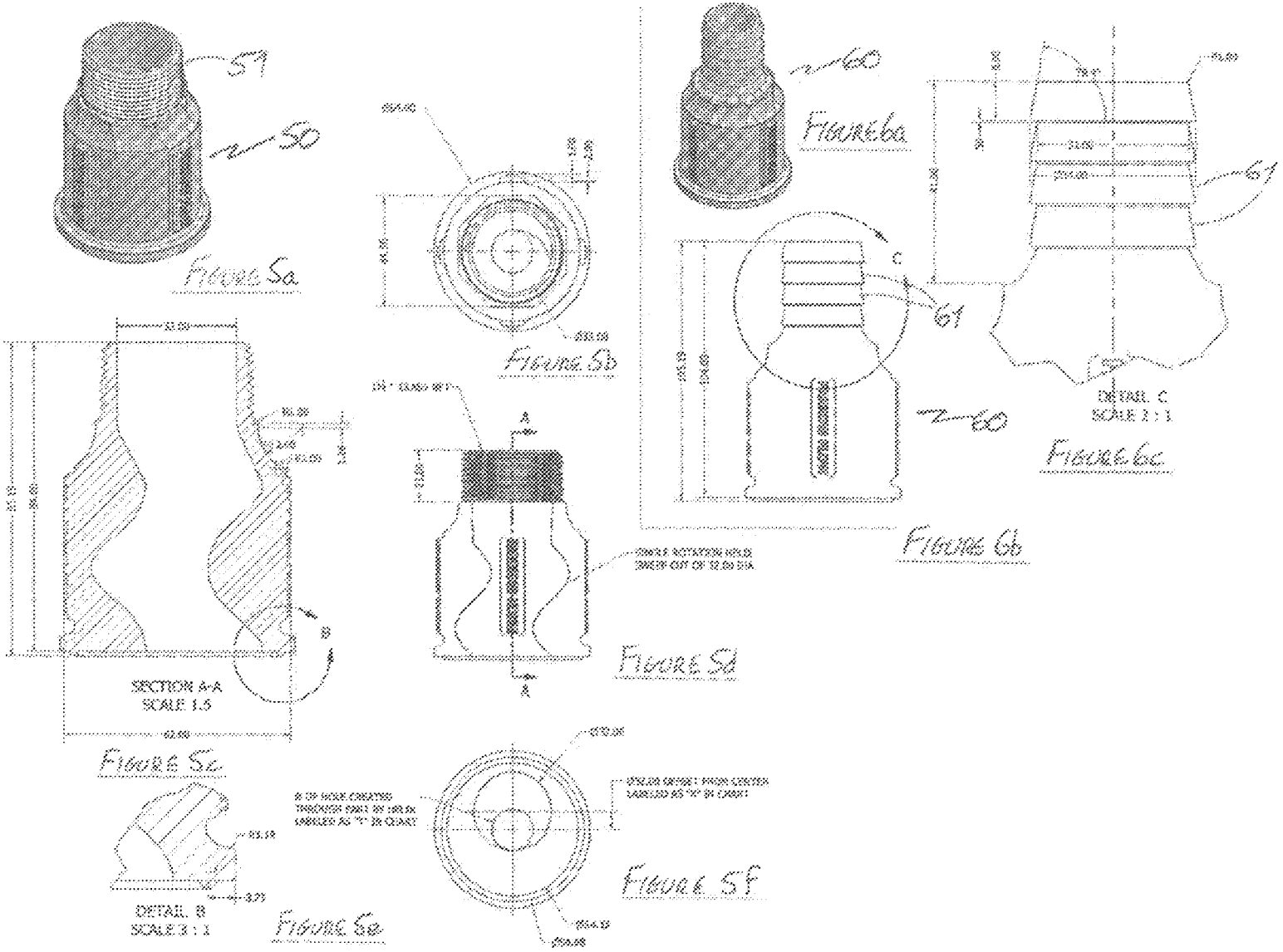
FIGS. 5*a*-5*f* illustrate a fifth embodiment of an insert.
Figures 5A, 5B, 5C, 5D, 5E, 5F, 6A, 6B, 6C, 6D, 6E, 6F:
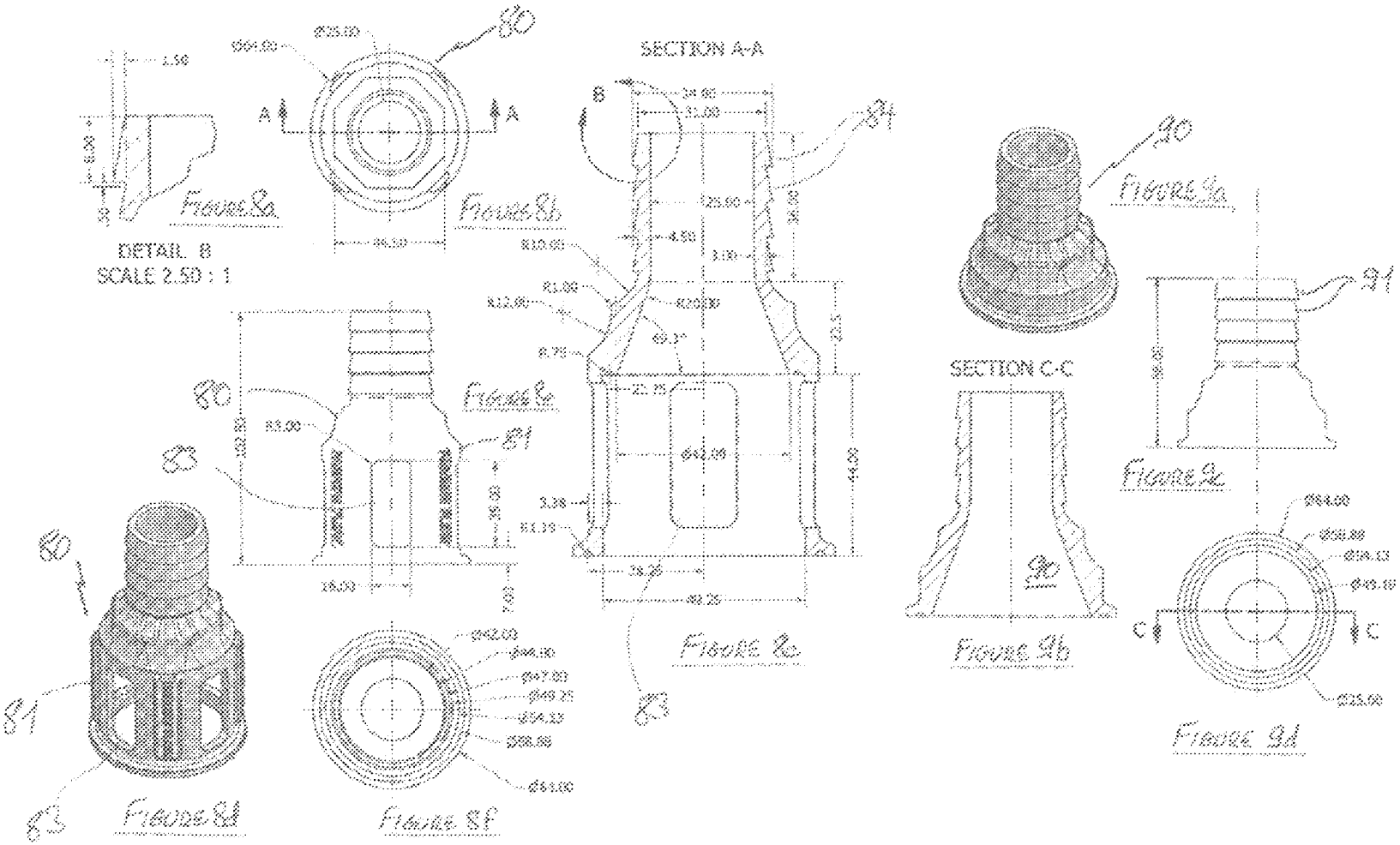
FIGS. 6*a*-6*c* illustrate a sixth embodiment of an insert.
Figure 10A:
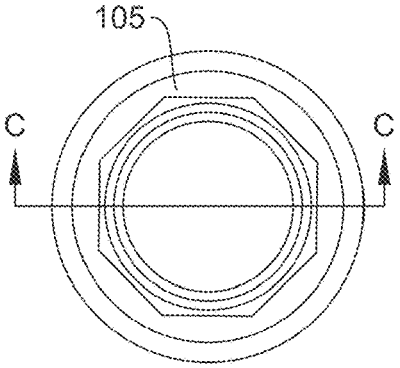
FIGS. 10*a*-10*f* illustrate a fourth embodiment of an insert holder.
Figure 10B:
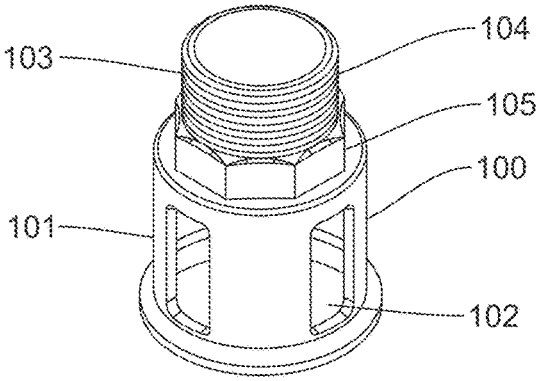
Figure 10C:
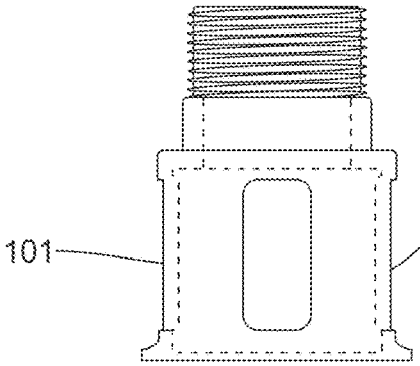
Figure 10D:
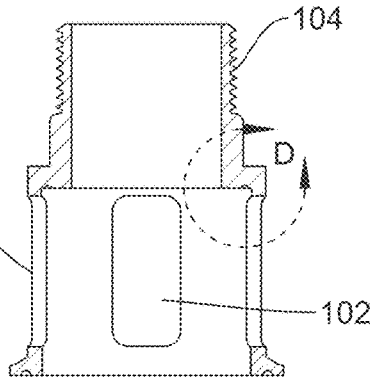
Figure 10E:
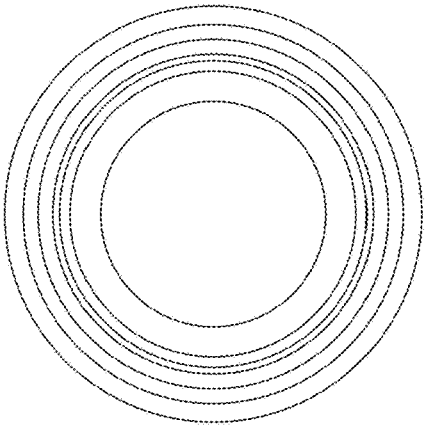
Figure 10F:
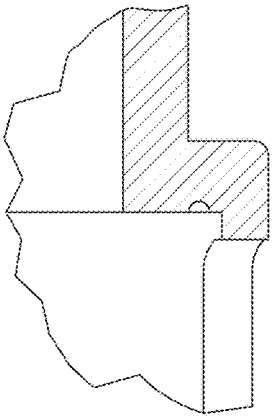

The sixth embodiment of insert 60 shown in FIGS. 6*a*-6*c* has an internal helical structure as described for the above embodiments. Externally however, this embodiment includes an externally deployed structure comprising nested frusto-conical sections 61 which facilitate the insert 60 being pushed into a hose, but act to resist the removal of the insert so that the insert 60 does not fall out of the hose during use.

Figure 12A:
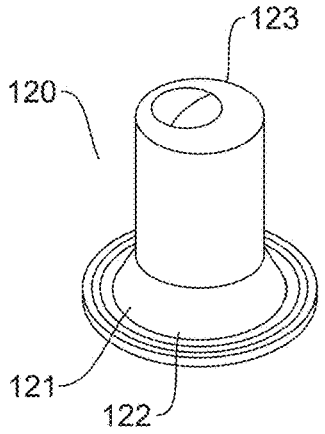
FIGS. 12*a*-12*c* illustrate a seventh embodiment of an insert.
Figure 12B:
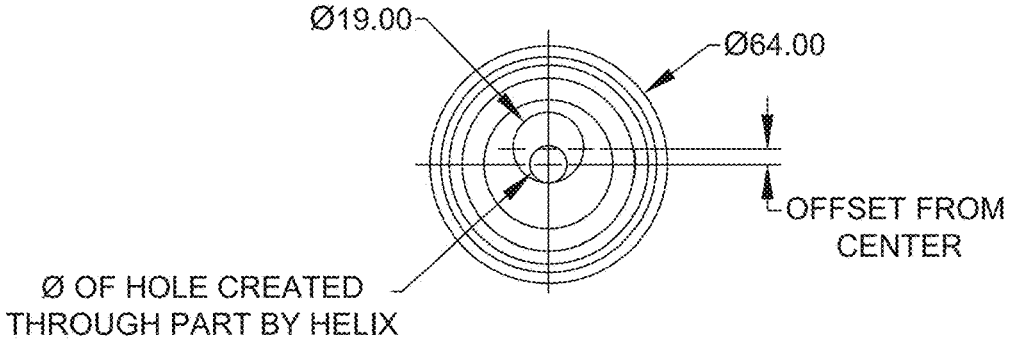
Figure 12C:
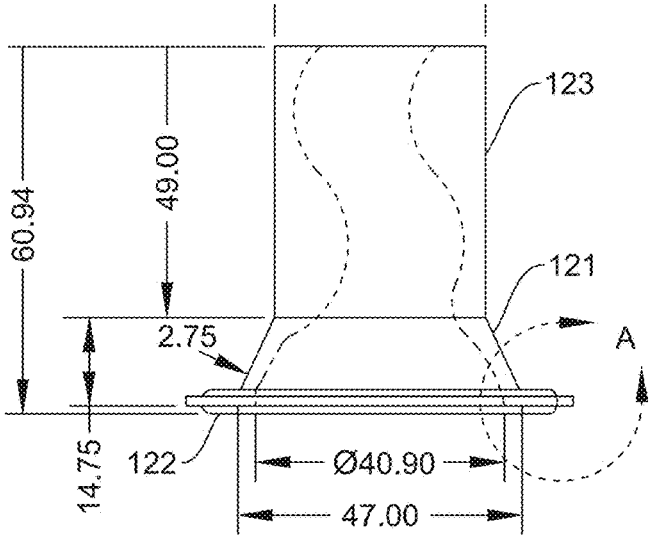

In FIGS. 12*a*-12*c*, a seventh embodiment of insert 120 is disclosed. The seventh embodiment includes, as does the fourth embodiment, a frusto-conical section 121 interposed between the flange 122 and the cylindrical body 123. The channel in this embodiment has a constant diameter of 19 mm along its length.

In the exemplified seventh embodiment, 3 values for each of these parameters were chosen. In a first experiment a channel diameter of 12.5 mm and an offset of 3.25 mm were chosen. In a second experiment, a channel diameter of 10 mm and an offset of 4.5 mm were chosen. In a third experiment, a channel diameter of 7.5 mm and an offset of 5.75 mm were chosen. The cleaning results for the first experiment were inferior to those obtained for the second and third experiments, with the third experiment being far superior. This is in spite of the ratio of the channel diameter to the offset being relatively constant for all three experiments.

FIGS. 7*a*-7*e* illustrate an insert holder for use, particularly in conjunction with a first embodiment of insert, for example shown in FIG. 1. The use of a holder facilitates attachment and removal of an insert, to for example replace a worn insert or to change inserts to provide a different flow pattern. A holder also acts to prevent an insert from spinning about its axis during use. The holder 70 shown in FIG. 7 has a generally cylindrical hollow body 71 to receive an insert. The flange 72 acts as a stop to prevent the insert from being pushed too far into the holder 70 and aids in correct alignment of the insert. Extending from one end of the cylindrical body 71 is a connector 73 having an outer thread. The connector 73 enables the holder 70 to be screwed into position within a conduit and the holder is profiled to a hexagonal form 74 to facilitate attachment using conventional tools.

FIGS. 8*a*-8*f* illustrate a second embodiment of a holder 80. The holder 80 has a generally cylindrical hollow body 81 to receive an insert and a flange 82 to aid in correct alignment of the insert. The cylindrical body 81 has a plurality of throughapertures 83 in regular array about the circumference of the cylindrical body 81. The series of nested frusto-conical sections 84 provide a fitment means as for the previous embodiment.

The connection piece 90 of FIGS. 9*a*-9*d* has a fitment means 91 formed of frusto-conical sections 91 as for the abovedescribed holder 80. The body of the connection piece 90 is however shorter than in the embodiment of FIG. 8 and can be utilised where no return regulator is present in a compressor as shown in FIG. 11.

The holder 100 of FIG. 10 combines features from the abovedescribed embodiments. The holder 100 has a cylindrical hollow body 101 having a plurality of throughapertures 102 in regular array about the circumference of the body 101. Extending from one end of the cylindrical body 101 is a connector 103 having an outer thread 104. The connector 103 enables the holder 100 to be screwed into position within a conduit and the holder is profiled to a hexagonal form 105 to facilitate attachment using conventional tools.

Figure 11:
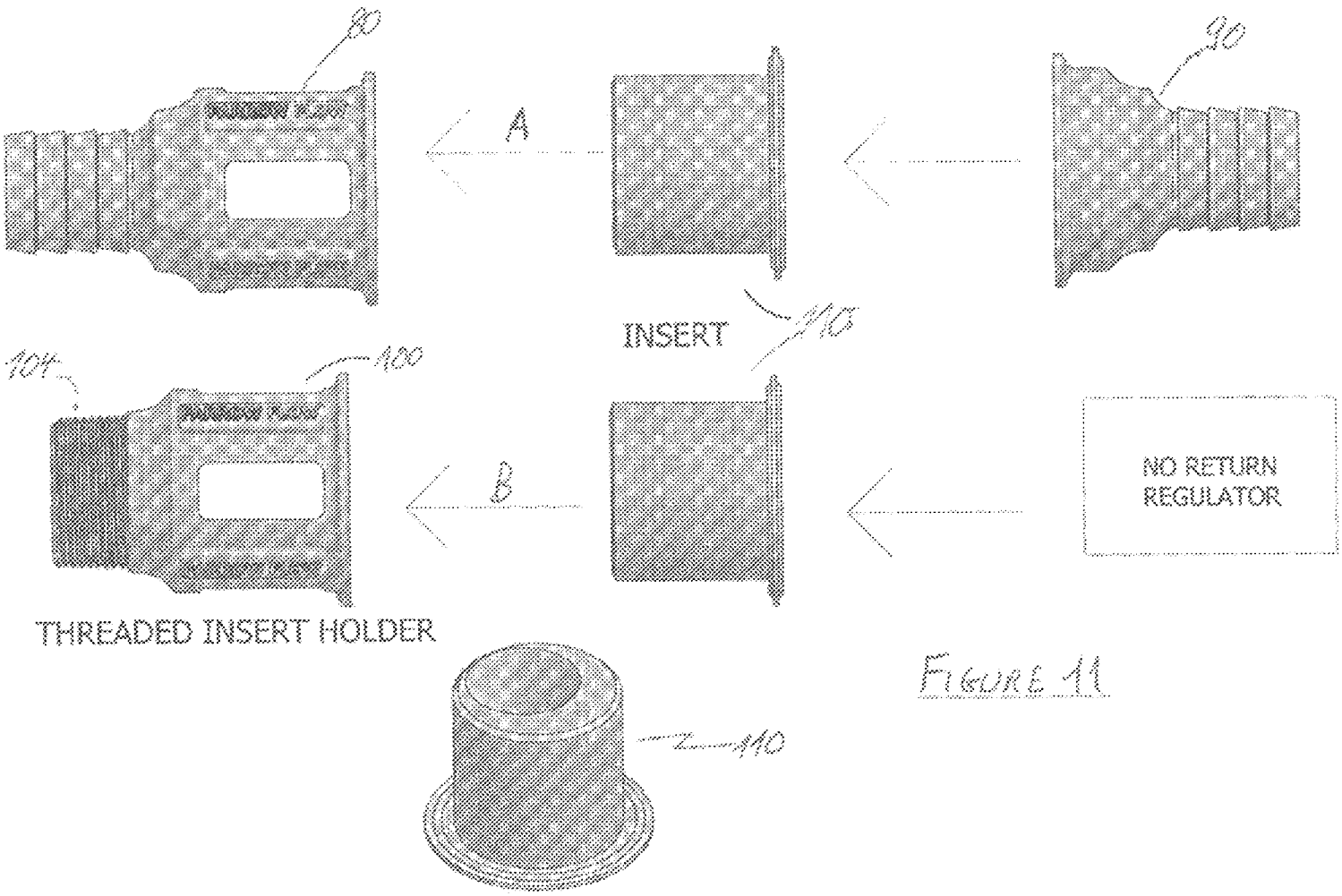
FIG. 11 illustrates fitment of an insert in accordance with the first embodiment to a second embodiment of an insert holder.

FIG. 11 illustrates the process of fitting an insert 110 into position when using a compressor having a return regulator (upper row of illustration) and when no return regulator is present (lower row). In the upper row the holder 80 is push-fit into a free end of a blast hose. An insert 110 is inserted into the holder 80 as shown by the arrow A. A connection piece 90 is inserted into a further section of a hose in fluid connection with a compressor supplying pressurised fluid. The connection piece 90 and the holder 80 are then connected together co-operating to retain the insert 110 aligned in the correct position.

With respect to the lower row, then a holder 100 as described in relation to FIG. 10 is secured to the end of a hose by means of the screw-thread 104. The insert 110 is inserted into the holder 100 as shown by the arrow B. The fluid connection to the compressor is then secured to the free end of the insert 110.

Figure 13:
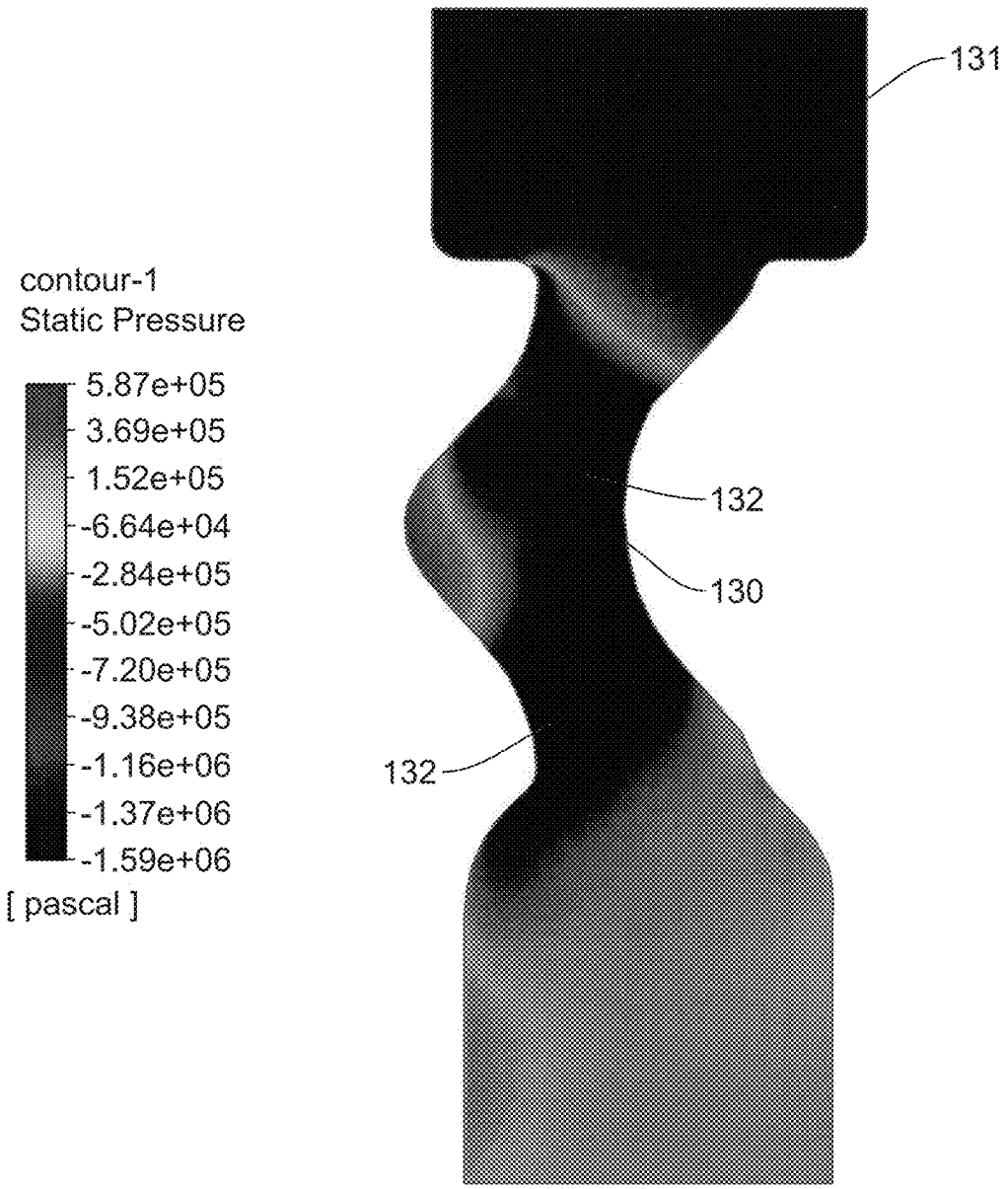
FIGS. 13 and 14 illustrate, respectively, the pressure and velocity profiles within an insert having an input pressure of 6 bar.
Figure 14:
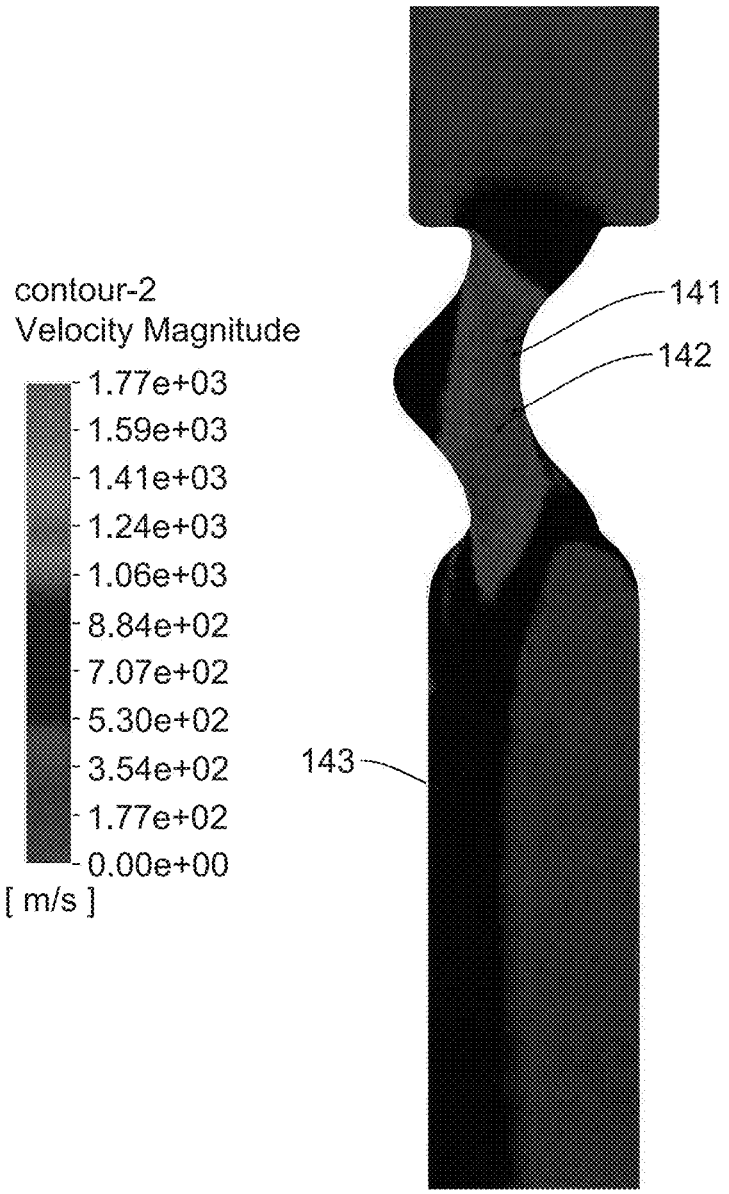
Figure 15:
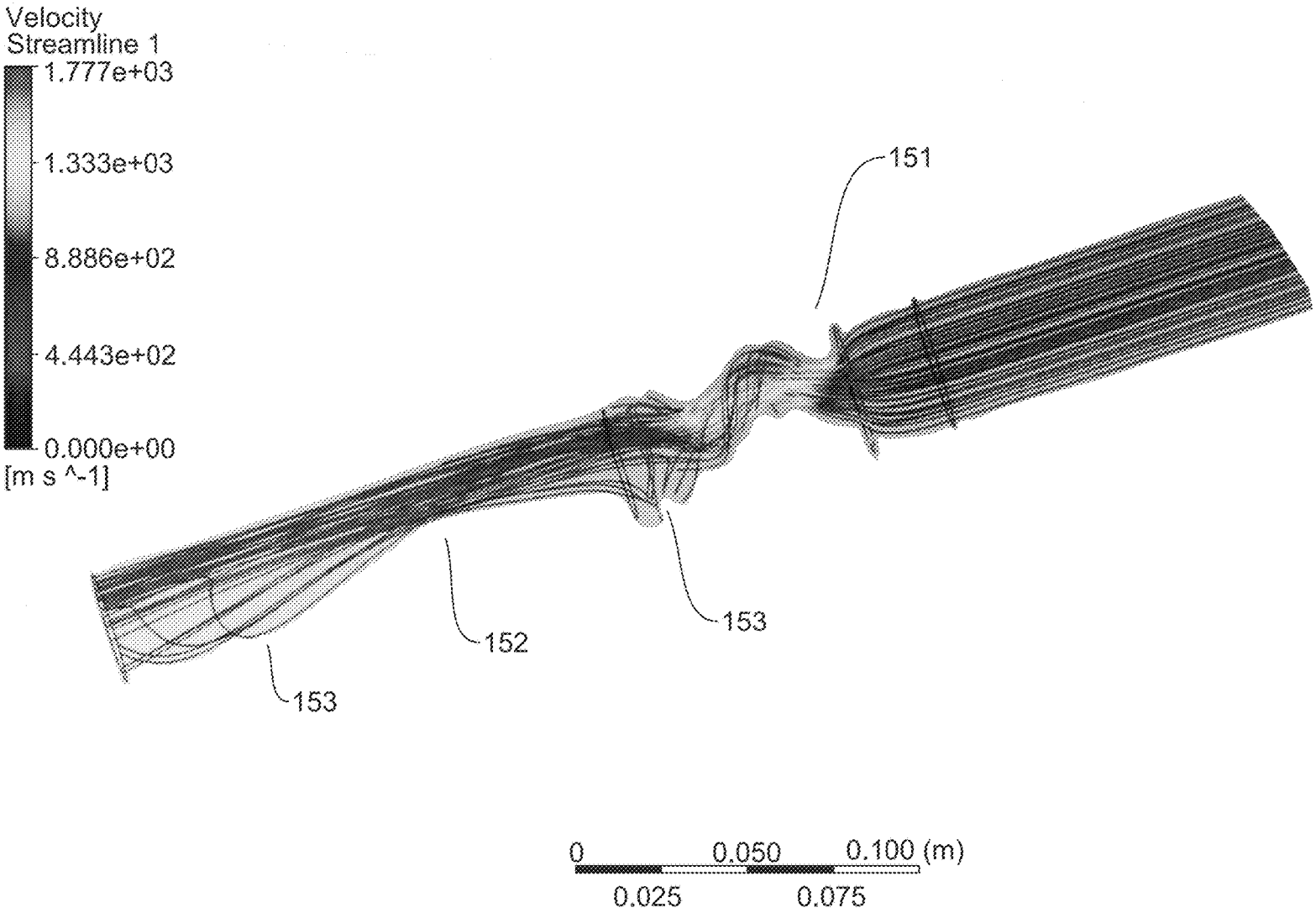
FIGS. 15-17 illustrate the flow of fluid through an insert in accordance with the invention.
Figure 16:
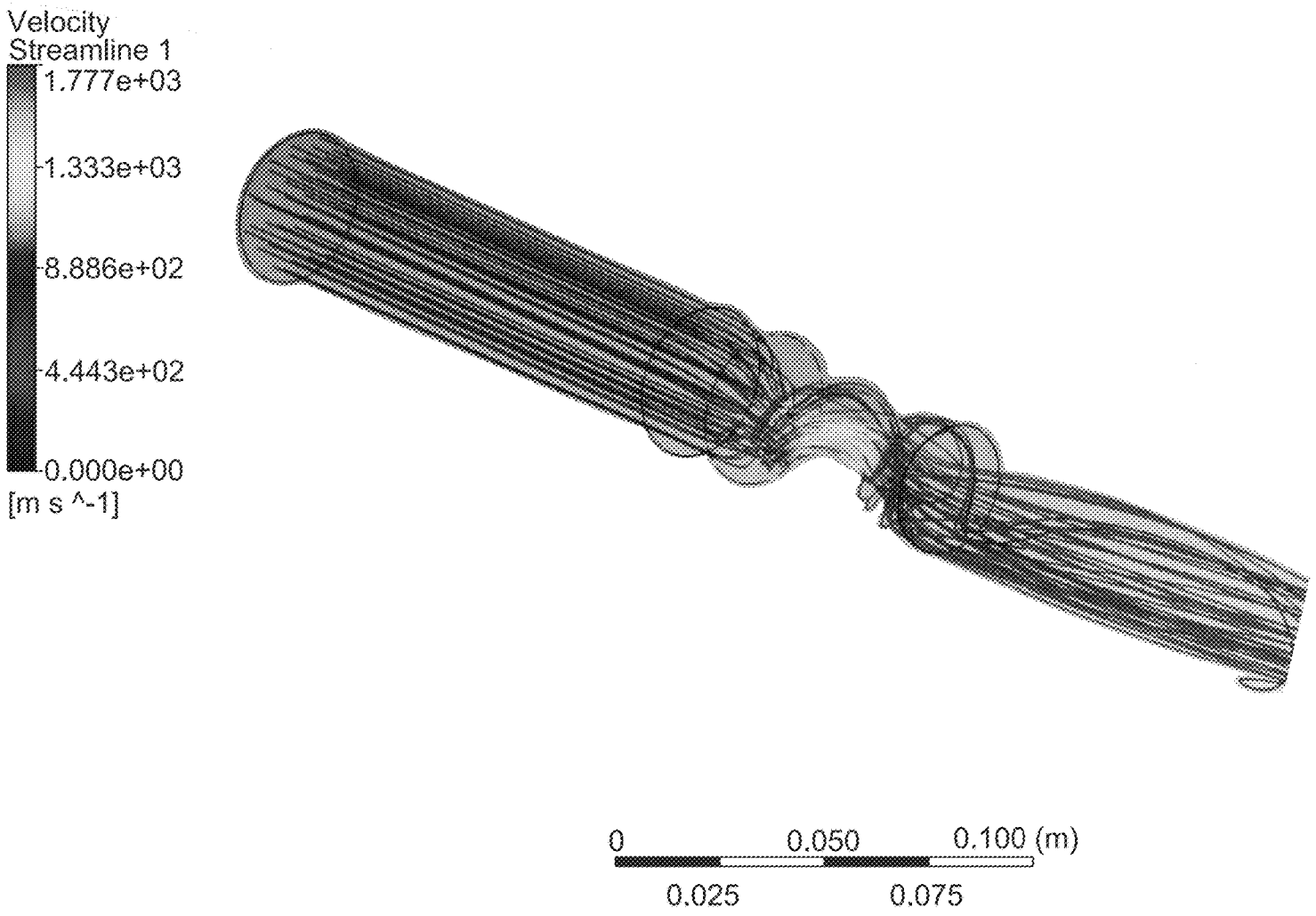
Figure 17:
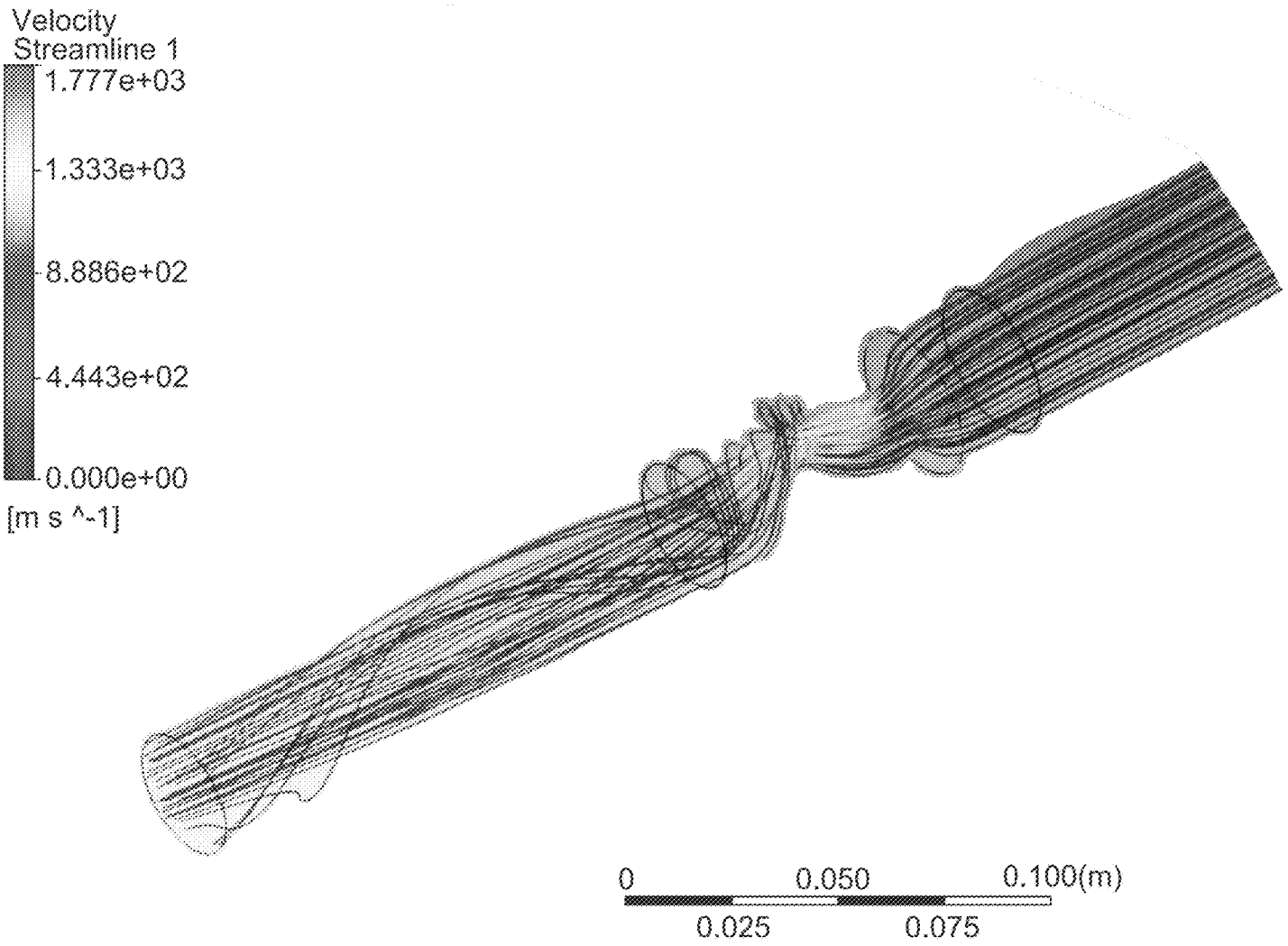

Without being bound to theory, it is believed that the inserts of the current invention described above act to more efficiently retain energy within the flow of fluid as kinetic energy. FIG. 13 illustrates the pressure within a flow stream having an insert 130 within the flow stream. On the compressor side of the insert 130, designated 131, the pressure is a uniform 6 bar. As the fluid moves into the insert, the pressure drops in the region 132. As the fluid enters the distal end of the insert 130, the pressure drops again. In the velocity diagram, FIG. 14, the velocity rises as it enters the insert at 141 and also stratifies around the middle of the helical flow path 142. Once the fluid leaves the insert, the velocity drops, but a portion of the flow 143 continues to be at a higher velocity than the fluid entering the insert, and the higher velocity flow persists well beyond the insert. FIGS. 15-17 confirm the increased velocity within the insert at 151, with the persistence of higher velocity flow 152 beyond the insert. It can also be seen that an element of the rotational flow about the axis of the flow pipe also persists 153.

When carrying out blasting, one phenomenon which often occurs is the production of a shock wave within a nozzle, in which momentum is converted into heat energy. The current invention acts to improve energy usage in that, although a shock wave takes place it takes place outside the nozzle and often after the fluid flow has impacted the surface to be cleaned. The fluid therefore has higher momentum at the point of impact than would be the case without the insert. This action is facilitated by the relatively short length of the insert in which the circular flow about the insert axis is generated in a short period of time.

The invention claimed is:

1. An apparatus, comprising:

an insert (10) securable within a fluid pathway of a fluid delivering conduit, the insert comprising:

a body (11, 21);

a first fluid inlet disposed at a first end of the body;

a body length axis (e.g., A-A, FIG. 3*b*) disposed normal to a plane passing through the first body end and extending, from a center of the first fluid inlet, between the plane and a second body end disposed opposite the first body end;

a first fluid outlet disposed at the second body end;

an internally disposed fluid-guiding channel (13, 23) extending as an uninterrupted path through the body between the first fluid inlet and the first fluid outlet, the channel being defined in-part, by a circumferentially disposed arcuate boundary line segment swept along a helical path with respect to the body length axis; and a flowpath, for fluid in the channel, defined by a centroid location of corresponding channel cross-sections along the helical path such that the flowpath is offset from the body length axis to guide fluid, that is flowing through the channel, toward a corresponding helical flow, the channel having a channel length extending along the flowpath; wherein:

first coupling structure is associated with the body, the first coupling structure being operable to place the fluid inlet in fluid-tight communication with cooperating second coupling structure carried at a discharge end of the fluid delivering conduit; and a boundary edge of the channel is disposed at a radius from the body length axis by a distance larger than an outside radius of the fluid delivering conduit.

2. An apparatus, comprising:

an insert (10) securable within a fluid pathway of a fluid delivering conduit, the insert comprising:

a body (11, 21);

a first fluid inlet disposed at a first end of the body;

a body length axis (e.g., A-A, FIG. 3*b*) disposed normal to a plane passing through the first body end and extending, from a center of the first fluid inlet, between the plane and a second body end disposed opposite the first body end;

a first fluid outlet disposed at the second body end;

an internally disposed fluid-guiding channel (13, 23) extending as an uninterrupted path through the body between the first fluid inlet and the first fluid outlet, the channel being defined in-part, by a circumferentially disposed arcuate boundary line segment swept along a helical path with respect to the body length axis; and a flowpath, for fluid in the channel, defined by a centroid location of corresponding channel cross-sections along the helical path such that the flowpath is offset from the body length axis to guide fluid, that is flowing through the channel, toward a corresponding helical flow, the channel having a channel length extending along the flowpath; wherein:

first coupling structure is associated with the body, the first coupling structure being operable to place the fluid inlet in fluid-tight communication with cooperating second coupling structure carried at a discharge end of the fluid delivering conduit; and the body further comprises a flange (12) disposed to protrude radially at the first body end; and a frusto-conical section (41) connects the flange to the body, the frusto-conical section tapering from a larger diameter to a smaller diameter in the direction of the first fluid outlet.

3. The apparatus according to claim 2, wherein:

the insert is configured and arranged such that a direction of fluid flow through the first fluid inlet is parallel to a direction of fluid flow in the first fluid outlet.

4. The apparatus according to claim 2, wherein:

the channel is circular in cross-section along a portion of the channel length; and the ratio of a channel diameter, at a location disposed along the portion of channel length, to a corresponding offset distance of the flowpath from the body length axis, is between 0.5 and 1.3.

5. The apparatus according to claim 2, wherein:

the ratio of the channel diameter to the corresponding offset distance of the flowpath is between 0.7 and 1.3.

6. The apparatus according to claim 5, wherein:

the ratio of the channel diameter to the corresponding offset distance of the flowpath is 1.3.

7. The apparatus according to claim 2, wherein:

at least one end of the body carries a threaded element (24, 26).

8. The apparatus according to claim 2, wherein:

at least one end of the body carries a hose barb (61).

9. The apparatus according to claim 2, wherein:

at least one end of the body provides an exterior surface that is chamfered (14) to facilitate assembly of the apparatus.

10. The apparatus according to claim 2, wherein:

a cross-section of the channel (23) has a characteristic size that is constant along a portion of the channel length.

11. The apparatus according to claim 2, wherein:

a cross-section of the channel (45) has a characteristic size that is tapered, being larger at a fluid inlet end.

* * * * *